US005714302A

United States Patent [19]

Urasaki et al.

[11] Patent Number: 5,714,302

[45] Date of Patent: Feb. 3, 1998

[54] METHOD OF PRINTING WITH USING LITHOGRAPHIC PRINTING PLATE MADE BY SILVER COMPLEX DIFFUSION TRANSFER PROCESS AND USING DAMPENING COMPOSITION CONTAINING NONIONIC SURFACE ACTIVE AGENT

[75] Inventors: Jun Urasaki; Hideo Kiyoyama; Hiroyuki Kurokawa; Kazuhiko Ibaraki; Akio Yoshida, all of Tokyo, Japan

[73] Assignee: Mitsubishi Paper Mills Limited, Tokyo, Japan

[21] Appl. No.: 605,885

[22] Filed: Feb. 23, 1996

Related U.S. Application Data

[63] Continuation-in-part of Ser. No. 183,940, Jan. 21, 1994, abandoned.

[30] Foreign Application Priority Data

Jan. 26, 1993 [JP] Japan ..... 5-011030

[51] Int. Cl.[6] ..... G03C 5/54

[52] U.S. Cl. ..... 430/204; 430/264; 430/331; 101/450.1; 101/451

[58] Field of Search ..... 430/264, 204, 430/331; 101/450.1, 451; 106/2; 524/505, 376, 502

[56] References Cited

U.S. PATENT DOCUMENTS

| | | | |
|---|---|---|---|
| 3,108,535 | 10/1963 | Uhlig | 101/451 |
| 3,877,372 | 4/1975 | Leeds | 101/465 |
| 4,238,279 | 12/1980 | Tsubai et al. | 156/664 |
| 4,501,811 | 2/1985 | Saikawa et al. | 430/204 |
| 4,510,228 | 4/1985 | Tsubai et al. | 430/204 |
| 4,621,041 | 11/1986 | Saikawa et al. | 430/204 |
| 4,854,969 | 8/1989 | Bassemir et al. | 106/2 |
| 4,956,261 | 9/1990 | Pawlowski et al. | 430/176 |
| 5,163,999 | 11/1992 | Uchida et al. | 106/2 |
| 5,296,336 | 3/1994 | Doi et al. | 430/321 |
| 5,399,280 | 3/1995 | Woo et al. | 252/142 |

FOREIGN PATENT DOCUMENTS

| | | |
|---|---|---|
| 3006094 | 8/1981 | Germany . |
| 40 14 960 | 11/1991 | Germany . |
| 57-199693 | 12/1982 | Japan . |
| 58-176280 | 10/1983 | Japan . |
| 61-55480 | 11/1986 | Japan . |
| 3-92392 | 4/1991 | Japan . |

OTHER PUBLICATIONS

Polymer Science Dictionary, Mark S. M. Alger pp. 373 and 399.

*Primary Examiner*—George F. Lesmes
*Assistant Examiner*—Laura Weiner
*Attorney, Agent, or Firm*—Cushman Darby & Cushman IP Group of Pillsbury Madison & Sutro LLP

[57] ABSTRACT

The present invention provides a printing method using a silver salt lithographic printing plate obtained by imagewise exposing a silver salt lithographic printing plate precursor comprising a support and, provided thereon, at least a silver halide emulsion layer and a physical development nuclei layer and then subjecting the exposed printing plate precursor to silver complex diffusion transfer development and using a dampening composition containing a nonionic surface-active agent represented by the following formula [I]:

$$RO\left(CH_2CH_2O\right)_{n_1}\left(\overset{CH_3}{\overset{|}{C}}HCH_2O\right)_{n_2}H \qquad [I]$$

wherein R represents an alkyl group of 1–9 carbon atoms, and $n_1$ and $n_2$ are mol numbers necessary for the polymer having an average molecular weight of 250 or more, and $n_1/n_2$ is 0.5–2, and a polymer represented by the following formula [II]:

$$H\left(CH_2CH\right)_m H \qquad [II]$$
$$\quad\quad |$$
$$\quad O{=}P{-}OH$$
$$\quad\quad |$$
$$\quad\quad OH$$

wherein m is a number which provides a number-average molecular weight of 2000–50000 for the polymer. By applying the above-mentioned dampening composition to the silver salt printing plate, a sufficiently high printing performance can be obtained without using colloidal silica or colloidal alumina in the dampening composition.

4 Claims, No Drawings

METHOD OF PRINTING WITH USING LITHOGRAPHIC PRINTING PLATE MADE BY SILVER COMPLEX DIFFUSION TRANSFER PROCESS AND USING DAMPENING COMPOSITION CONTAINING NONIONIC SURFACE ACTIVE AGENT

This application is a continuation-in-part application of application Ser. No. 08/183940 filed on Jan. 21, 1994.

BACKGROUND OF THE INVENTION

The present invention relates to a method of printing which is carried out using a lithographic printing plate made by silver complex diffusion transfer process and using a dampening composition containing a nonionic surface active agent.

A lithographic printing plate comprises oleophilic image portions which are receptive to oily inks and oil-repellent non-image portions which are not receptive to the inks. In general, said non-image portions are receptive to water, namely, hydrophilic. Usual lithographic printing is carried out by feeding both water and ink to the surface of printing plates to allow the image portions to receive preferentially the coloring ink and the non-image portions to receive preferentially water and, then, transferring the ink on the image portions onto a substrate such as paper. Therefore, in order to obtain good prints, it is necessary that the difference between oleophilicity of the image portions and hydrophilicity of the non-image portions is sufficiently great so that when water and ink are fed to the surface of the plate the image portions can receive sufficient amount of ink while the non-image portions do not utterly receive the ink.

Lithographic printing plates made by utilizing silver complex diffusion transfer process (DTR process), especially those which have a physical development nuclei layer on a silver halide emulsion layer are disclosed, for example, in U.S. Pat. Nos. 3,728,114, 4,134,769, 4,160,670, 4,336,321, 4,501,811, 4,510,228, and 4,621,041. These lithographic printing plates have physical development nuclei in an emulsion layer containing gelatin as a binder or on the surface of the emulsion layer, and the exposed silver halide crystal in the emulsion layer undergoes chemical development by the DTR development and is converted to black silver to form hydrophilic non-image portions. On the other hand, unexposed silver halide crystal is converted to a silver complex with a silver salt complexing agent contained in the developer, and the complex diffuses toward the surface physical development nuclei layer and undergoes physical development in the presence of the nuclei to form image portions mainly composed of an ink receptive physical development silver.

The silver image portions are ink receptive and the surface of gelatin of the non-image portions is ink repellent, and the printing plate having these portions is used for printing. The surface of gelatin is hydrophilic as it is, but is not sufficient in water retention properties.

On the other hand, in PS plates made using a photosensitive resin which are generally used in the field of offset printing, an aluminum sheet having an anodized surface is used as a support, and the anodized surface per se forms the non-image portions and, therefore, the non-image portions have a markedly high water retention.

In the field of conventional plate making, roomlight films are used in the reversing step owing to complexity of prints and development of scanners, and a final film (a complete block copy) is prepared by the collection from many film originals. Usually, this film is contact printed on a PS plate, followed by processing to obtain a printing plate. On the other hand, the lithographic printing plates using the silver complex diffusion transfer process is made by a method generally called direct plate making, namely, a complete block copy prepared by superposing reflective originals is photographed by a process camera having a reversal mirror, followed by diffusion transfer processing to directly obtain a lithographic printing plate. As compared with the system of film/PS plate, the direct plate making method has the features such as low cost and time-saving, but suffers from the problems that printing endurance is at most several ten thousand in terms of the number of prints and the image quality deteriorates due to the optical systems. However, this printing method is used for printing of small lot utilizing the above merits and PS plates are used for printing of medium or large lot.

When the silver salt printing plate and the PS plate are used properly utilizing the respective features thereof as mentioned above, of course, it is preferred that the dampening solution used for printing is such one which is common to both of the printing plates. However, the dampening solutions actually used essentially differ depending on the difference in water retention of the non-image portions in both the printing plates as mentioned above and the common use of one dampening solution for both the printing plates has been impossible.

That is, isopropyl alcohol (IPA) which is generally known as a dampening solution for PS plate cannot be applied to the silver salt printing plates of the present invention because considerable printing stains occur. On the other hand, dampening solutions used for silver salt printing plates generally contain inorganic fine particles such as colloidal silica and colloidal alumina, and when these dampening solutions are applied to PS plates, there occur problems such as unevenness in the image portion and reduction of image density in printing.

Furthermore, the dampening solutions containing inorganic fine particles used for the silver salt printing plates have the problem in stability against pH and electrolyte concentration. That is, the stability of inorganic fine particles depends greatly upon pH or electrolyte concentration, and if the pH is adjusted to 5–6 under the necessity for the dampening solution, precipitation occurs and if it is adjusted to 8 or higher, gelling of the solution occurs. Moreover, when electrolyte compounds such as those which contain Na, Ca, Mg or the like are added for the adjustment of pH or control of electroconductivity, gelling of the solution occurs or precipitation occurs.

For solving the above problems, namely, for attaining the common use of a dampening solution for both the silver salt printing plates and PS plates, it is natural that the dampening solution must be improved from the side of the silver salt printing plates which are inferior in the water retention and in the extent of demand, further taking into consideration the historical background. Furthermore, this is the chance of being able to simultaneously accomplish the improvement of conventional dampening solutions for silver salt printing plates.

Moreover, from the aspect of PS plates, use of dampening solution improved for the purpose of common use has consequentially the merit that omission of IPA in the conventional dampening solutions for PS plates can be attained (use of organic solvents has the problems in industrial safety and hygiene and as dangerous articles in the fire law).

SUMMARY OF THE INVENTION

The object of the present invention is to provide a printing method realizing an excellent printability by using a silver salt printing plate and a dampening composition improved in order to be able to be also used for PS plates.

The above object has been attained by a method of printing which uses a silver salt lithographic printing plate obtained by imagewise exposing a silver salt lithographic printing plate precursor comprising a support and, provided thereon, at least a silver halide emulsion layer and a physical development nuclei layer and then subjecting the exposed printing plate precursor to silver complex diffusion transfer development and which uses a dampening composition containing a nonionic, polymeric surface-active agent represented by the following formula [I]:

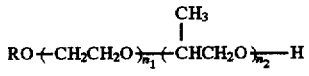

[I]

wherein R represents an alkyl group of 1–9 carbon atoms, and $n_1$ and $n_2$ are mol numbers necessary in order for the polymer having a number-average molecular weight of 250 or more/and $n_1/n_2$ is 0.5–2, and a polymer represented by the following formula [II]:

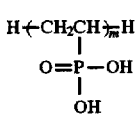

[II]

wherein m is a number which provides a number-average molecular weight of 2000–50000.

The nonionic surface active agent used in the dampening composition of the present invention comprises a hydrophilic portion having a propylene oxide group unit and an ethylene oxide group unit and a hydrophobic portion of an alkyl group of 1–9, preferably 4–9 carbon atoms and has a number-average molecular weight of 250 or more, preferably 500–3000. The upper limit of the molecular weight is generally 5000, but it may exceed 5000.

The nonionic surface active agents represented by the formula [I] are known compounds and are commercially available, and are, for example, series of UNILUBE-50 MB (trademark) (e.g. 50 MB-26) of Nippon Oil & Fats Co., Ltd.

The nonionic surface active agent is contained preferably in an amount of 1–10 g per one liter of the dampening composition (as a working solution), but may be contained in an amount outside the above range. The nonionic surface active agent contained in the above range attains efficient decrease of dynamic surface tension and increase of viscosity.

The compounds represented by the formula [II] used in the present invention are polycondensates of vinylphosphonic acid monomers and are commercially available.

The polymerization degree of the polymer is preferably m=20–90 and the polymer is contained preferably in an amount of 10–100 mg per one liter of the dampening composition (as a working solution).

The dampening composition of the present invention improves the defects encountered when the conventionally known inorganic fine particles such as colloidal silica and colloidal alumina are contained and it is preferred that the dampening composition of the present invention does not substantially contain these inorganic fine particles, but it can contain them in such an amount that they do not give adverse effect as mentioned above, for example, less than 1 g per 1 liter of the dampening composition (working solution).

The processing activity of the dampening composition of the present invention can be modified by adding the known materials such as oil-desensitization accelerator, buffer, preservative and wetting agent. Examples of these materials are gum arabic, carboxymethylcellulose, sodium alginate, polyvinyl pyrrolidone, polyvinylimidazole, polyvinylphosphoric acid, sulfates (such as sodium sulfate and ammonium sulfate), phosphoric acid, nitric acid and tannic acid and salts of these acids, polyol compounds having two or more hydroxyl groups (such as polyethylene glycol, ethylene glycol, propylene glycol and diethylene glycol), organic weak acids (such as citric acid, succinic acid, tartaric acid, adipic acid, ascorbic acid and propionic acid), inorganic fine particles (such as alumina sol and colloidal silica), polyacrylic acid, ammonium bichromate, chromium alum, aminopolycarboxylates (such as sodium ethylenediaminetetraacetate).

In addition, there may be added water-miscible organic solvents such as methanol, dimethylformamide and dioxane or colorants such as phthalocyanine dyes, Malachite Green and Nile Blue in a slight amount especially considering the appearance.

The silver salt lithographic printing plate precursors processed utilizing silver complex diffusion transfer process are disclosed, for example, as those which have a physical development nuclei layer on a silver halide emulsion layer in U.S. Pat. Nos. 3,728,114, 4,134,769, 4,160,670, 4,336,321, 4,501,811, 4,510,228, and 4,621,041.

Examples of the silver salt lithographic printing plate precursors are those which comprise a support and, provided thereon, an undercoat layer, a silver halide emulsion layer and a physical development nuclei layer. The silver halide emulsions include, for example, silver chloride, silver bromide, silver chlorobromide, silver chloroiodide and silver chlorobromoiodide, and these silver halides preferably contain at least 70 mol % of silver chloride and especially preferably contain at least 80 mol % of silver chloride. Average grain size of the silver halide is preferably in the range of 0.2–0.6 microns. The silver halide grains may be doped with a metal ion such as rhodium, iridium or the like. The emulsion may contain a gelatin hardener, a coating aid, an antifoggant, a plasticiser, a developing agent, a matting agent, a pH adjustor, etc.

In these silver halides, there may be used spectral sensitizing dyes depending on light sources and uses, for example, type of camera, type of laser beam and type of panchromatic film. Anion or betaine type cyanin sensitizing dyes are especially preferred.

As binders for the silver halide emulsions, there may be used natural and/or synthetic binders which are generally used for this purpose, such as gelatin, colloidal albumin, cellulose derivatives, etc.

An undercoat layer may be provided under the silver halide emulsion layer (on the surface of the support) as an adhesion improving subbing layer and/or for the purpose of antihalation. This layer can also contain a developing agent and a matting agent.

As the supports for the silver halide emulsion layer, there may be used paper, various films, plastics, paper coated with resinous materials, metals, etc.

As the physical development nuclei used for the physical development nuclei layer, there may be used those which are known for this purpose and examples thereof are metals such as antimony, bismuth, cadmium, cobalt, palladium, nickel, silver, lead and zinc, and sulfides of these metals. The physical development nuclei described in Japanese Patent Kokai No. 5-265164 may also be used. The physical development nuclei layer may also contain a developing agent and a water-soluble binder.

The silver salt lithographic printing plate precursors as explained above are available, for example, as SLM-RII (trademark) from Mitsubishi Paper Mills Ltd.

The above-mentioned silver salt lithographic printing plate precursor prepared using a silver halide is subjected to imagewise exposure and then, to silver complex diffusion transfer development (DTR development) to obtain a lithographic printing plate.

The exposed silver halide crystal undergoes chemical development by the DTR development and is converted to black silver to form hydrophilic non-image portions. On the other hand, unexposed silver halide crystal is converted to a silver salt complex with a silver salt complexing agent contained in the developer, and the complex diffuses toward the surface physical development nuclei layer and undergoes physical development in the presence of the nuclei to form image portions mainly composed of an ink receptive physical development silver.

The DTR developers contain alkali agents such as sodium hydroxide, potassium hydroxide, lithium hydroxide and sodium tertiary phosphate, preservatives such as sulfites, silver halide solvents such as thiosulfates, thiocyanates, cyclic imides, 2-mercaptobenzoic acid and amines, developing agents such as hydroquinones, catechol and 1-phenyl-3-pyrazolidone, and others.

Moreover, as described in British Patent Nos. 1,000,115, 1,012,476, 1,017,273 and 1,042,477, the developing agent may be contained in the silver salt lithographic printing plate precursors and activated high-alkali developers containing substantially no developing agent, namely, so-called "alkaline activated solutions" may be used as the developers.

The lithographic printing plates made by the development treatment can be enhanced in ink-receptivity of the silver image portions by using etch solutions containing compounds having a mercapto group.

The present invention will be illustrated by the following nonlimiting examples.

EXAMPLE 1

The dampening solutions (working solutions) having the following compositions were prepared.

| | |
|---|---|
| Propionic acid | 0.2 g |
| Sodium nitrite | 1.0 g |
| The surface active agent | 0 g or 5 g |
| The polymer | 50 mg |
| IPA | 0 g or 200 g |
| Water to make up 1 liter in total. | |

The surface active agent, the polymer and IPA are shown below.

| Sample | | Surface active agent (R) | Polymer ($n_1 = n_2$) | (m = 55) | IPA |
|---|---|---|---|---|---|
| 1 | Comparative | Not used | | Used | Not used |
| 2 | The present invention | n-butyl | 5 | Used | Not used |
| 3 | The present invention | n-butyl | 9 | Used | Not used |

-continued

| Sample | | Surface active agent (R) | Polymer ($n_1 = n_2$) | (m = 55) | IPA |
|---|---|---|---|---|---|
| 4 | The present invention | n-butyl | 20 | Used | Not used |
| 5 | The present invention | n-octyl | 5 | Used | Not used |
| 6 | The present invention | n-octyl | 9 | Used | Not used |
| 7 | Comparative | n-butyl | 5 | Not used | Not used |
| 8 | Comparative | n-butyl | 20 | Not used | Not used |
| 9 | Comparative | Not used | | Not used | Used |
| 10 | Comparative | Ethyl cellosolve | | Not used | Not used |
| 11 | Comparative | Ethyl cellosolve | | Not used | Used |
| 12 | Comparative | Butyl cellosolve | | Used | Not used |
| 13 | Comparative | Butyl cellosolve | | Used | Used |
| 14 | Comparative | H | 5 | Used | Not used |
| 15 | Comparative | H | 5 | Used | Used |

Evaluation of the dampening solutions was conducted on the following items.

1. Measurement of dynamic surface tension: The dynamic surface tension was measured at 21° C. using an automatic dynamic surface tensiometer FACE JET-2 manufactured by Kyowa Kaimen Kagaku Co.

2. Measurement of viscosity: The viscosity was measured at 25° C. using an E-type viscometer (VISCONIC ED) manufactured by Tokyo Keiki Co., Ltd.

3. Inhibition of staining and fill-in of dot portion (actual printing evaluation):

Silver salt printing plate: SLM-RII (trademark) manufactured by Mitsubishi Paper Mills, Ltd. was imagewise exposed and subjected to development and neutralization (using SLM-Ac and SLM-St manufactured by Mitsubishi Paper Mills Ltd.) to make a printing plate, namely, a printing plate made using silver complex diffusion transfer process.

PS plates (as references): FNS and FPS (trademarks) manufactured by Fuji Photo Film Co., Ltd. as PS plates made using photosensitive resins.

Ink: F Gloss Kon-ai manufactured by Dainippon Ink & Chemicals Inc.

Printing machine: HEIDELBERG T-OFFSET (Model TOK).

Evaluation was conducted by the following criteria.

Inhibition of staining:

The number of prints obtained before stain occurred.

X: Less than 500

Δ: 500–1000

○: More than 1000

Fill-in of dot portion:

The number of prints obtained before 50% of dots were collapsed.

X: Less than 500

Δ: 500–1000

○: More than 1000

TABLE 1

| Sample No. | Surface tension (mN/m) | Viscosity (CP) | Stain: Silver salt printing plate SLM | Stain: PS plates FNS | Stain: PS plates FPS | Fill-in of dot image: Silver salt printing plate SLM | Fill-in of dot image: PS plates FNS | Fill-in of dot image: PS plates FPS |
|---|---|---|---|---|---|---|---|---|
| 1 | 79 | 1.31 | x | Δ | Δ | x | Δ | Δ |
| 2 | 47 | 1.36 | ○ | ○ | ○ | ○ | ○ | ○ |
| 3 | 49 | 1.40 | ○ | ○ | ○ | ○ | ○ | ○ |
| 4 | 50 | 1.43 | ○ | ○ | ○ | ○ | ○ | ○ |
| 5 | 50 | 1.52 | ○ | ○ | ○ | ○ | ○ | ○ |
| 6 | 48 | 1.52 | ○ | ○ | ○ | ○ | ○ | ○ |
| 7 | 46 | 1.31 | Δ | ○ | ○ | Δ | Δ | Δ |
| 8 | 50 | 1.40 | Δ | ○ | ○ | Δ | Δ | Δ |
| 9 | 53 | 1.39 | x | ○ | ○ | x | ○ | ○ |
| 10 | 73 | 1.12 | x | Δ | Δ | x | Δ | Δ |
| 11 | 55 | 1.21 | x | Δ | Δ | Δ | Δ | Δ |
| 12 | 68 | 1.36 | Δ | Δ | Δ | Δ | Δ | Δ |
| 13 | 70 | 1.39 | Δ | Δ | Δ | Δ | Δ | Δ |
| 14 | 52 | 1.39 | Δ | Δ | Δ | Δ | Δ | Δ |
| 15 | 52 | 1.39 | x | Δ | Δ | x | Δ | Δ |

As explained above, by using the improved dampening composition of the present invention, it becomes possible to obtain a sufficiently high printing performance without using colloidal silica or colloidal alumina which has been used in conventional dampening compositions.

Furthermore, the printing results obtained by using the PS plates used for reference and using the dampening composition of the present invention are similar to those obtained by using the conventional dampening compositions containing IPA. Thus, the dampening composition of the present invention can be used for both the silver salt printing plates and the PS plates.

Moreover, the dampening composition of the present invention has the feature of containing no IPA which is a merit for PS plates.

What is claimed is:

1. A method of printing comprising the steps of:

employing a silver salt lithographic printing plate obtained by imagewise exposing a silver salt lithographic printing plate precursor comprising a support and, provided thereon, at least a silver halide emulsion layer and a physical development nuclei layer;

subjecting the exposed printing plate precursor to silver complex diffusion transfer development; and subjecting the thus developed printing plate to a treatment with a dampening composition containing A) a nonionic, polymeric surface-active agent represented by the following formula (I):

$$RO\left(CH_2CH_2O\right)_{n_1}\left(CH(CH_3)CH_2O\right)_{n_2}H \quad [I]$$

wherein R represents an alkyl group of 1–9 carbon atoms, and $n_1$ and $n_2$ are mol numbers necessary for the polymer to have a number-average molecular weight of 250 or more and $n_1/n_2$ is 0.5–2, and B) a polymer represented by the following formula (II):

$$H\left(CH_2CH(OP(=O)(OH)OH)\right)_m H \quad [II]$$

wherein m is a number which provides a number-average molecular weight of 2000–50000 for the polymer.

2. A method according to claim 1, wherein the dampening composition is a solution and the concentration of the nonionic surface-active agent represented by the formula (I) is 1–10 g per liter of dampening composition.

3. A method according to claim 1, wherein the dampening composition is a solution and the concentration of the polymer represented by the formula (II) is 10–100 mg per liter of dampening composition.

4. A method according to claim 1, wherein the R in the formula [I] is an alkyl group of 4–9 carbon atoms.

* * * * *